United States Patent [19]

Etlin

[11] 4,170,194

[45] Oct. 9, 1979

[54] APPARATUS FOR ELECTROSTATIC DEPOSITION

[76] Inventor: Vladimir N. Etlin, 250 E. 73rd St., New York, N.Y. 10021

[21] Appl. No.: 741,893

[22] Filed: Nov. 15, 1976

[51] Int. Cl.[2] ..... B05B 5/02; B05D 1/06

[52] U.S. Cl. ..... 118/629; 118/312

[58] Field of Search ..... 118/629–635, 118/310, 312, 317, 318, 602, 603, DIG. 5, 653, 654; 427/21, 28, 181, 182, 185, 27, 29

[56] References Cited

U.S. PATENT DOCUMENTS

| | | | |
|---|---|---|---|
| 1,534,627 | 4/1925 | Leomans | 118/312 X |
| 2,602,417 | 7/1952 | Medcalf | 118/312 X |
| 2,602,418 | 7/1952 | Paasche | 118/312 |
| 2,763,575 | 9/1956 | Bede | 118/602 X |
| 3,655,438 | 4/1972 | Sterling et al. | 427/39 X |
| 3,831,555 | 8/1974 | Srinivas | 118/506 |
| 3,918,401 | 11/1975 | Blakeslee | 118/312 X |
| 3,946,125 | 3/1976 | Scheiber | 118/DIG. 5 |
| 3,976,031 | 8/1976 | Itoh | 118/629 |
| 3,982,050 | 9/1976 | Kato et al. | 427/238 X |
| 4,036,170 | 7/1977 | Goodheim | 118/408 X |

FOREIGN PATENT DOCUMENTS

| | | | |
|---|---|---|---|
| 1910487 | 9/1970 | Fed. Rep. of Germany | 118/312 |

*Primary Examiner*—Morris Kaplan

[57] ABSTRACT

The specification discloses a means and method for electrostatic coating of objects with synthetic resinous powdered material in which increased electrostatic charges are placed upon the powdered coating material before they are moved through the vicinity of the article to be coated by subjecting them to acceleration in a closed circuitous path from which they are tapped for movement to the coating area.

7 Claims, 5 Drawing Figures

PRIOR ART

APPARATUS FOR ELECTROSTATIC DEPOSITION

BACKGROUND OF THE INVENTION

The field of powder coating of both metallic and non-mettalic articles has gained substantial prominence in relatively recent years owing to the development of new electrostatic coating powders capable of being subsequently heat fused at lower temperatures and shorter curing times. This type of protective coating offers many advantages over wet spray coating, including the effective utilization of as much as 95% of the powder materials as compared with a maximum of 60% in the case of wet painting. Energy consumption is markedly reduced, because one powder coat may be made as thick as required, and covers better and cures at lower temperatures than three or four wet paint coats. In the case of coating hollow articles, such as elongated length of pipe and the like, the ability to flow an air current carrying the powder through the bore of the pipe permits even coating in a manner substantially unobtainable by spray techniques.

At the present state of development of the art, there are various methods using electrostatically charged powder. The most widely used are those including an electrostatic generator, a high voltage spray nozzle, and a tank containing powder with a mechanical mixer. The process is carried out in a spray booth, and exposes personnel to the powder as it is sprayed, and the possibility of shock from the electrically powered components of the apparatus. Powder losses are comparable with material losses involved in spray painting, and unused powder is not easily reclaimed. Pollution of the surrounding atmosphere is substantial.

SUMMARY OF THE INVENTION

Briefly stated, the invention contemplates the provision of a coating apparatus which includes a closed pipe circuit into which powder is introduced, the circuit having branches in which articles to be coated are placed, as well as a loop in which the powder particles are accelerated to very high speeds prior to entry into the branches, whereby they acquire a very high charge of static electricity. When the particles have obtained sufficient velocity, the branches containing the articles to be coated are placed in communication with the loop circuit, whereby the particles enter the branches to become electrostatically attracted to the articles. Powder flow is continued until a coating of desired thickness is obtained, following which the branches are again cut off from the loop circuit, and the article is heated for curing of the powder. During the curing process, the loop circuit again reaccelerates the remaining powder for subsequent use, either in the same branch, or in different branches communicating with the loop circuit. Because the electrostatic charge is acquired solely as a result of high velocity turbulence, the need for a static generator and spray nozzle is eliminated. Additionally, because the coating is performed in a closed circuit, atmospheric contamination is considerably reduced, if not eliminated, and any powder not used in coating may be scavenged from the branch circuits for reuse. No powder tank and mixer are necessary, and powder coating may be applied to the interior surface of a long object without modification of equipment.

BRIEF DESCRIPTION OF THE DRAWING

In the drawing, to which reference will be made in the specification.

DETAILED DESCRIPTION OF THE DISCLOSED EMBODIMENTS

Figure 1:
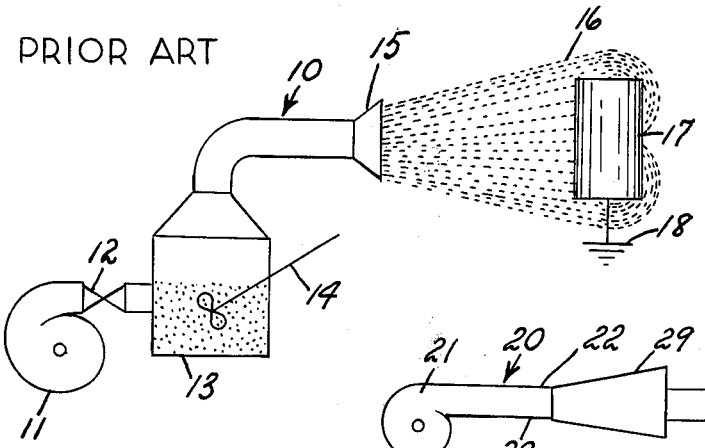
FIG. 1 is a schematic elevational view showing a prior art apparatus.

With reference to FIG. 1 in the drawing, there is illustrated a typical prior art device for applying charged electrostatic coating particles to an object to be coated. The prior art device, generally indicated by reference character 10 includes a blower element 11 serially connected to valve means 12, a powder tank 13 having mechanical agitation means 14, the tank, in turn, communicating with an electrically charged nozzle 15, a flow of air from the blower serving to discharge a cloud of powder 16 to an object 17 for coating. The article is usually connected to a source of ground potential 18. The device 10 is normally housed in a spray booth (not shown) or similar enclosure, which confines powder which does not become attracted to the article, and at periodic intervals, waste powder may be swept up for reprocessing and reuse. As is the case with conventional wet painting, a great number of particles do not adhere to the article being coated, and material waste often runs as high as 35% of the volume of powder used.

Figure 2:
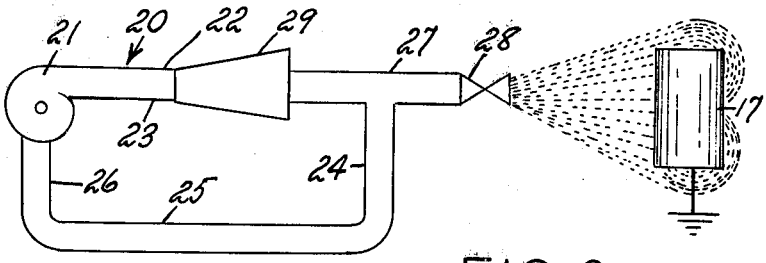
FIG. 2 is a similar schematic elevational view showing a first embodiment of the invention.

FIG. 2 illustrates a first embodiment of the invention, generally indicated by reference character 20. The embodiment includes a high velocity blower 21 in series with a loop circuit conduit 22 including first, second, third and fourth elongated members 23, 24, 25 and 26, respectively. A branch conduit 27 communicates with a combination valve and spray nozzle 28. During operation, a quantity of powder is introduced into the loop circuit 22, and with the valve 28 in closed position, the blower is operated to continuously cycle the powder at high velocity, whereby upon contacting the inner surfaces of the circuit 22, it acquires a high electrostatic charge in the absence of any other charging means. When sufficient charge has been accumulated, the valve 28 is opened, and the powder allowed to travel to impinge upon the object 17. This structure, it will be noted, eliminates the necessity of the presence of the powder tank 13 and mechanical agitator 14, and the valve-nozzle 28 need have no means incorporated therein for the imparting of a charge to the particles, which had been previously charged in the closed circuit before reaching the nozzle. As in the prior art device of FIG. 1, the embodiment 20 must be used in conjunction with a spray booth or similar enclosure.

Figure 3:
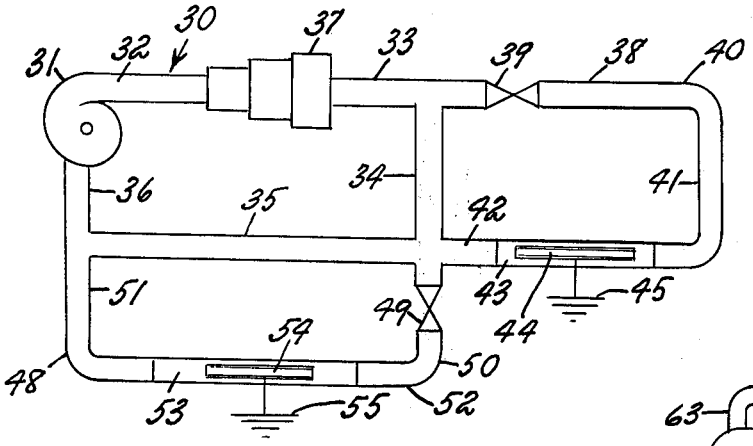
FIGS. 3 is a schematic elevational view showing a second embodiment of the invention.

FIG. 3 illustrates a second embodiment of the invention, generally indicated by reference character 30. This embodiment includes a blower element 31, a loop element 32 including members 33, 34, 35, and 36. An optional wide section 37 or 29 in FIG. 2, tapering outwardly in the direction of the flow may be incorporated to increase turbulence whereby the electrostatic charge is built up more readily. The circuit 32 selectively communicates with a first branch circuit 38 including a valve 39 and members 40, 41 and 42. Member 42 includes a selectively openable chamber 43 for retaining an article 44 to be coated, the article having an optional grounding connection 45. A second branch 48 includes a valve 49 and members 50, 51 and 52, member 52 having a similar openable chamber 53 enclosing a second article 54 for coating, the article having an optional ground connection 55.

In the operation of the embodiment 30, the branch conduits 38 and 48 are used selectively. After sufficient charge has built up in the loop circuit 32, the valve 39 is opened, and remains open until the article 44 has acquired a coat of desired thickness. The valve 39 is then closed, and the article 44 heated to effect curing of the deposited powder, using any suitable means (not shown) such as a high frequency inductive heater or the like. While the curing of the deposited powder is taking place, the valve 49 may be opened, and without discontinuing operation of the blower element 31, the article 54 may be coated and the deposited powder cured in a similar manner. Other branch conduits, (not shown) may be provided, depending upon the relative times required for deposition of the powder and subsequent curing.

Figure 4:
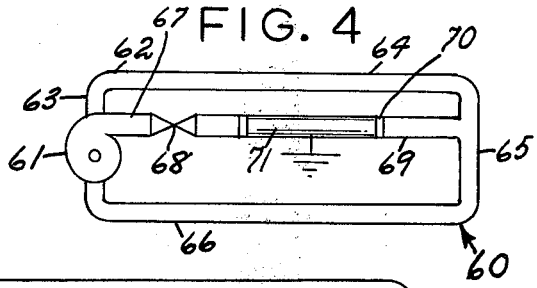
FIG. 4 is a schematic elevational view showing a third embodiment of the invention.

In the third embodiment illustrated in FIG. 4 in the drawing, a blower 61 powers a loop circuit 62 comprising member 63, 64, 65 and 66. A branch circuit 67 includes a valve 68 communicating with an elongated member 69 having an openable chamber 70 through article 71 to be coated. The article 71 to be coated is in the form of a hollow pipe, the outer diameter of which corresponds to the inner diameter of the member 69. Thus, the entire flow of particles is through the interior of the pipe, and since no part of the flow is diverted externally of the pipe, coating is substantially uniform.

Figure 5:
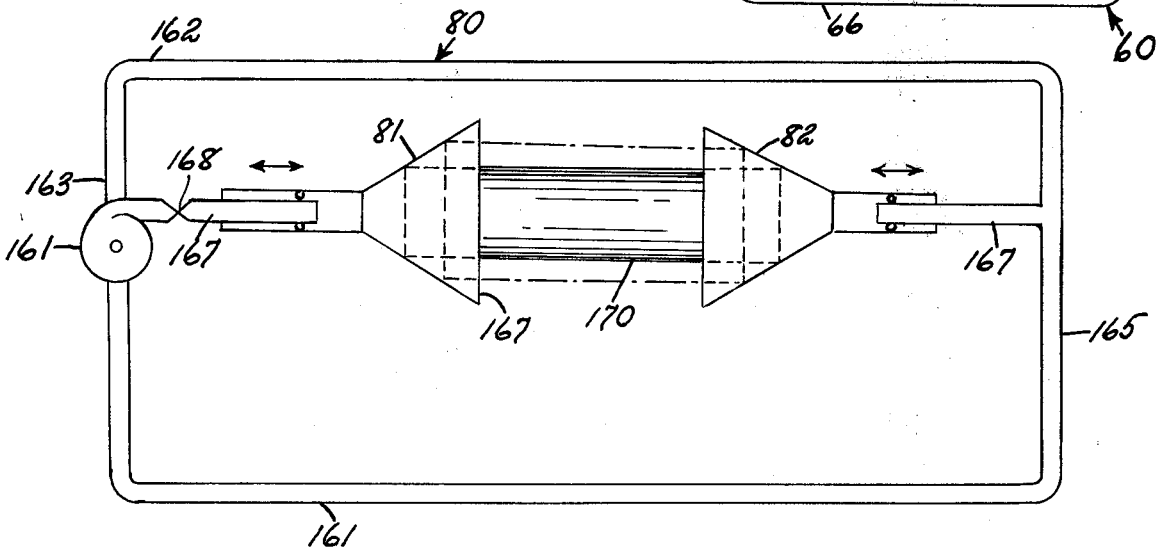
FIG. 5 is a schematic elevational view showing a fourth embodiment of the invention.

The fourth embodiment, generally indicated by reference character 80, and illustrated in FIG. 5 is substantially similar to that of FIG. 4, and, to avoid needless repetition, parts corresponding to those of the third embodiment have been designated by similar reference characters with the additional prefix "1".

In FIG. 5, the branch conduit, 167, is segmented, and is provided with axially aligned first and second funnel-like members 81 and 82, which are slidably adjustable on the segments of the conduit 167. As seen in FIG. 5, a wide variety of diameters and lengths of pipe can be accommodated by sliding the funnel-like members away from each other for purposes of loading, and sliding them together to engage the arcuate edges of the article 170 prior to commencement of the coating operation.

It will be observed that in the embodiments illustrated in FIGS. 3, 4 and 5, the powder is continuously recycled within the closed circuit, so that with care, up to 99% of the undeposited powder may be reused without reprocessing of any kind. I wish it to be understood that I do not consider the invention limited to the precise details of structure shown and set forth in this specification, for obvious modifications will occur to those skilled in the art to which the invention pertains.

I claim:

1. Apparatus for applying electrostatically charged powder to an article to be coated comprising:

a continuously open closed circuit conduit loop;

a supply of said powder within said loop;

a high velocity blower in series with said loop whereby to maintain said powder in high speed circulation through said loop and to develop a high electrostatic charge, in the circulating powder, through frictional contact;

said loop including an enlarged conduit section whereby to increase the turbulence of said circulating powder;

at least one branch conduit selectively communicating with said loop;

valve means within said branch conduit to establish said communication;

said branch conduit in said communication forming with part of said closed loop an additional closed loop;

said branch conduit being adapted to contain at least one said article to be coated;

whereby upon establishing said communication at least a portion of said high speed circulating powder is drawn through said additional closed loop to coat said article.

2. Apparatus as in claim 1 wherein a plurality of said article containing branch conduits are provided, each branch conduit being in selective communication with said first closed loop to form therewith an additional closed loop whereby to coat a said article and whereby in use at least one article containing branch conduit may be utilized in a coating operation while an additional step in the overall operation of the system is performed in the at least one other article containing branch conduit.

3. Apparatus as in claim 1 including heater means in combination with said branch conduit whereby to heat said article or to cure said coating.

4. Apparatus as in claim 2 including heater means in combination with each article containing branch conduit.

5. Apparatus in claim 1 wherein means, in combination with the branch conduit, electrically grounds said article to be coated.

6. Apparatus as in claim 4 wherein means, in combination with each said branch conduit, electrically grounds a said article to be coated.

7. Apparatus as in claim 2 wherein means, in combination with each said branch conduit, electrically grounds a said article to be coated.

* * * * *

UNITED STATES PATENT AND TRADEMARK OFFICE

CERTIFICATE OF CORRECTION

PATENT NO. : 4,170,194

DATED : October 9, 1979

INVENTOR(S) : Vladimir N. Etlin

It is certified that error appears in the above—identified patent and that said Letters Patent is hereby corrected as shown below:

Inventor's Address is:

7403 Lisle Avenue
Falls Church, Virginia 22043

Signed and Sealed this

*Twenty-seventh* Day of *May 1980*

[SEAL]

*Attest:*

SIDNEY A. DIAMOND

*Attesting Officer*

*Commissioner of Patents and Trademarks*